United States Patent [19]

Fricano

[11] Patent Number: 4,676,500

[45] Date of Patent: Jun. 30, 1987

[54] RETRACTABLE FANGS

[76] Inventor: Phillip J. Fricano, 8452 E. Roosevelt St., Scottsdale, Ariz. 85257

[21] Appl. No.: 702,921

[22] Filed: Feb. 19, 1985

[51] Int. Cl.[4] ..... A63J 3/00

[52] U.S. Cl. ..... 272/8 N; 446/27; D21/190

[58] Field of Search ..... 446/27, 26, 395, 391, 446/339, 337, 296, 491, 329, 268; 272/8 N, 27 N, 8 R, 27 R; 433/1, 26, 6, 177, 172; D21/190, 189

[56] References Cited

U.S. PATENT DOCUMENTS

D. 179,329 11/1956 Pierre ..... D21/190 X

FOREIGN PATENT DOCUMENTS 425672 2/1926 Fed. Rep. of Germany ..... 433/1

*Primary Examiner*—Mickey Yu

*Attorney, Agent, or Firm*—Woodling, Krost & Rust

[57] ABSTRACT

A disguise apparatus simulating extendable human fangs when worn in the human mouth. The apparatus has a first fang, a second fang and a connecting member. The connecting member has a first end portion, a second end portion, and an intermediate portion. The apparatus also has a first roller member and a second roller member. The first fang is attached to the first end portion of the connecting member and the second fang is attached to the second end portion of the connecting member. The first roller member and the second roller member are attached to the intermediate portion of the connecting member. The first end portion of the connecting member and the second end portion of the connecting members are adapted to reside primarily along the upper dental arch of the human mouth. The intermediate portion of the connecting member is adapted to reside primarily below the human tongue.

9 Claims, 5 Drawing Figures

RETRACTABLE FANGS

The disguise apparatus, which is fully disclosed herein, has as its primary purpose the simulation of extendable and retractable human fangs. When the apparatus is worn in the human mouth, it makes the wearer appear to have teeth-like human fangs. Thus, the wearer acquires a vampire-like image.

The preferred embodiment described herein has a first fang and a second fang. However, any number of teeth-like fangs could be employed in another embodiment. For instance, one tooth-like fang could be used to create a specific desired effect. Likewise, several teeth-like fangs could be used to create yet another desired effect. The particular embodiment using said first and second fangs has been found to be extremely well-suited for use in the human mouth.

An essential and important component of the preferred embodiment herein disclosed, is the connecting member. The connecting member has a first end portion, a second end portion, and an intermediate portion. The first and the second end portions are shaped similar to the upper dental arch of the human mouth. A first fang is attached to the first end portion. Correspondingly, a second fang is attached to the second end portion. As stated above, the first and the second end portions could have one or several teeth or fangs attached to them in any manner so desired. The first and the second end portions of the preferred embodiment extend approximately to the point of the upper human canine teeth when worn in the human mouth. Another embodiment may extend the first and the second end portions to the point where the first end portion and the second end portion join or nearly join. The point of joinder would be at or near the middle of the incisor teeth of the upper dental arch of the human mouth. If the end portions are extended, teeth-like fangs could be located at virtually every point around the upper dental arch of the mouth.

The intermediate portion of the connecting member provides two basic functions. First, the intermediate portion serves to link the first end portion and the second end portion together, the intermediate portion of the connecting member being generally loop-shaped. The loop is specifically designed so as to comfortably fit beneath the tongue while the makeup apparatus is worn inside the human mouth. Second, the intermediate portion serves as an attachment device to which a first roller member and a second roller member are attached. First and second roller members are attached to opposed end portions of the intermediate portion of the connecting member. The first and the second roller members are adapted to reside primarily between the upper and lower molars of the human dental arches. The first roller member and the second roller member provide the propelling force necessary to actuate the first and the second fangs. The propelling force is created by the wearer biting down softly on the rollers between his upper and lower molars, and then, moving his lower dental arch with respect to his upper dental arch. The propelling force could also be described as a "moment" or a "torque" as those terms are used in mechanics. The biting action in combination with the relative movement of the lower dental arch is responsible for the propelling force. In turn, the propelling force causes corresponding movement of the first end portion, the second end portion, and the intermediate portion. Movement of the first end portion and the second end portion thereby causes movement of the first and the second fangs. Therefore, the first and the second fangs can be extended at will by the wearer. It is important to note that the first and the second roller members could also be classified as first and second pivot members.

During normal use of the disguise apparatus, the intermediate portion of the connecting member remains beneath the tongue. However, the wearer may actuate the disguise apparatus in a slightly different fashion if he so chooses.

For instance, the wearer can push or pull on the intermediate portion of the connecting member with his tongue. In this mode of operation the biting action of the wearer is insignificant, if necessary at all. The first and the second roller members serve more of a pivoting function in this mode of operation than they do in the preferred mode of operation. But, the preferred mode of operation, namely wearing the intermediate portion of said connecting member beneath the tongue, has been found more comfortable than other modes of operation.

The preferred embodiment of the disguise apparatus can be used in at least one other way. The first and the second fangs could extend generally upwards from the lower dental arch rather than extending generally downwards as in the intended operation. This can be accomplished by simply orienting the disguise apparatus upside down and inserting it inside the mouth. When employing the disguise apparatus in the upside-down mode, the first and the second roller members are placed between the molars of the upper and lower dental arches of the human mouth. The first and the second fangs are propelled in the same manner during upside-down operation as disclosed above in the description of the preferred operation.

Other constructions of the disguise apparatus could be implemented that would effect virtually the same results as the preferred embodiment specifically disclosed herein. One such construction would entail the modification of the shape of the intermediate portion of the connecting member. That construction could be actuated similarly to any of the methods described above, or, a combination of the methods described above could be used. Another construction would entail the elimination of the intermediate portion altogether. This construction would, however, require that the first and the second end portions be joined together. This construction could also be actuated by biting down softly on the first and the second roller members and simultaneously moving the lower dental arch with respect to the upper dental arch. Either of the alternate constructions just described could be used upside down as described above concerning the preferred embodiment.

A more complete undestanding of the disguise apparatus and its uses may be had by referring to the following description and claims in conjunction with the accompanying drawings in which:

Figure 1:
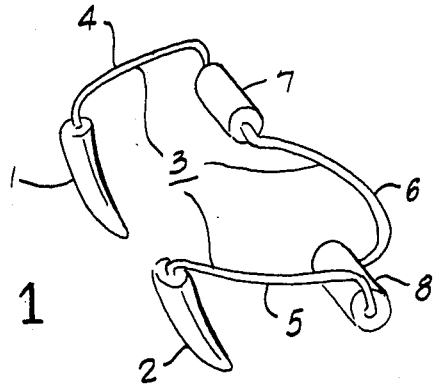
FIG. 1 is an isometric view of the major components of the disguise apparatus.

FIG. 1, the preferred embodiment, depicts the disguise apparatus and its constituent parts. The parts of the apparatus include a connecting member 3 having a first end portion 4, a second end portion 5 and an intermediate portion 6 therebetween. First 1 and second 2 fangs are respectively connected to the first and second end portions 4, 5 of the connecting member 3. Rollers 7, 8 are respectively connected and mounted at opposite ends of the intermediate portion 6. The rollers 7, 8 are fixedly connected to the intermediate portion 6 in the sense that they do not rotate relative thereto but rather move with the intermediate portion.

Figure 2:
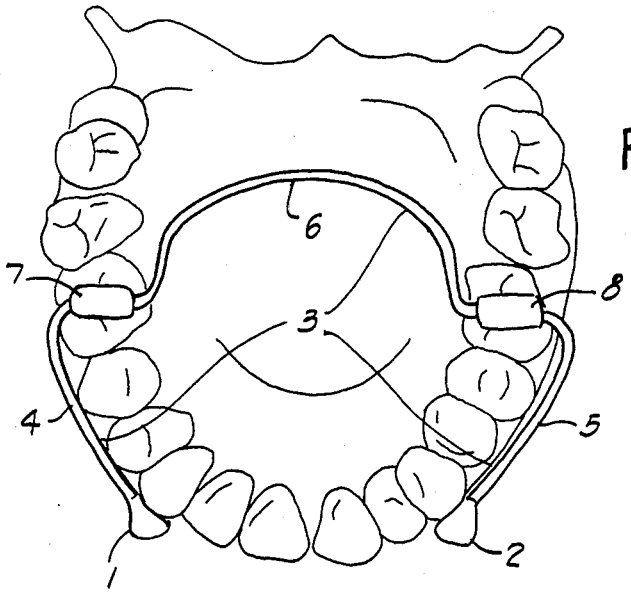
FIG. 2 is a top view of the disguise apparatus shown residing on and along the lower dental arch ofthe human mouth.
Figure 3:
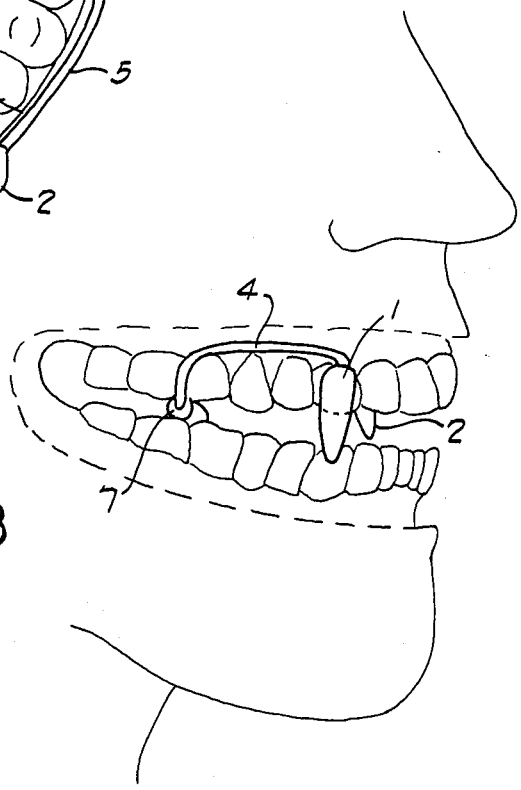
FIG. 3 is a side view of the disguise apparatus residing primarily within the human mouth.
Figure 4:
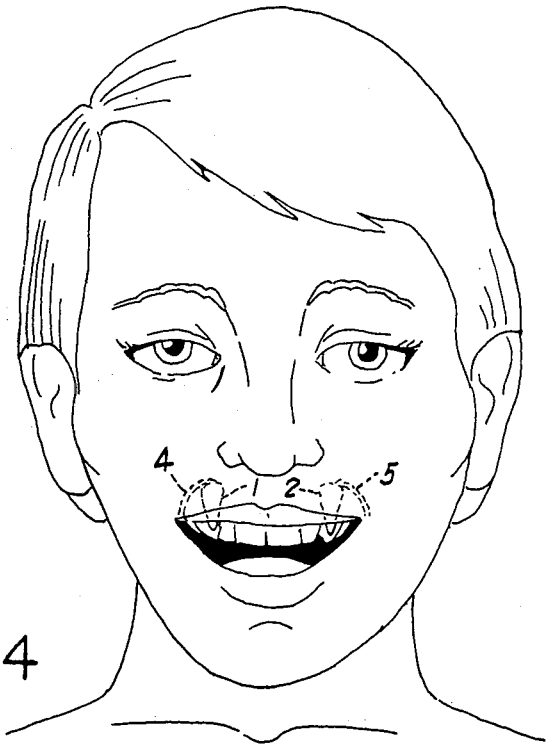
FIG. 4 is a front view of the disguise apparatus shown in the retractable position while residing in the human mouth.
Figure 5:
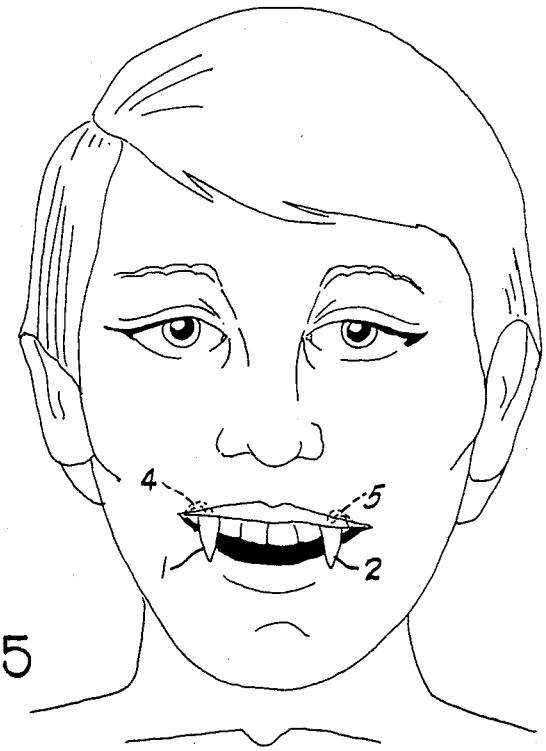
FIG. 5 is a front view of the disguise apparatus shown in the extended position while residing in the human mouth.

The first fang 1 and the second fang 2 are extendable and give the wearer a vampire-like appearance. FIG. 2 shows the first fang 1 and the second fang 2 residing in the neighborhood of the canine teeth of the lower dental arch of the human mouth. FIG. 3 depicts a side view of the first fang 1 and a portion of the second fang 2 as they reside primarily along the upper dental arch of the human mouth. FIG. 4 shows the first fang 1 and the second fang 2 in the retractable position. FIG. 5 shows the first fang 1 and the second fang 2 in the extendable position. Although the drawings indicate a first fang 1 and a second fang 2, any number may be employed thereby creating different effects (appearances).

The first fang 1 and the second fang 2 are made of injection molded polyvinylchloride (PVC), a plastic, and are generally tooth-shaped. PVC, as a material for the fangs, has been found to be comfortable and hygienic, thereby facilitating use of the disguise apparatus for long periods of time. Materials such as metals or other plastics may and can be used if desired; however, for the reasons enunciated above, PVC is used in the preferred embodiment.

An essential and important component of the preferred embodiment herein disclosed is the connecting member indicated by reference numeral 3. The connecting member is composed of three portions: the first end portion 4, the second end portion 5, and the intermediate portion 6. The first end portion 4 and the second end portion 5 are shaped similar to the upper dental arch of the human mouth. When in use the first end portion 4 and the second end portion 5 reside primarily along the upper dental arch of the human mouth. This can be seen best by referring to FIG. 3. It can also be seen, to a lesser extent, by referring to FIG. 4 and FIG. 5. In the preferred embodiment, the first end portion 4 and the second portion 5 extend approximately to the canine teeth of the upper dental arch. Another embodiment could extend the first end portion 4 and the second end portion 5 to different lengths. Ultimately, if the first and the second end portions were extended far enough, they would join or nearly join at or about the incisor teeth of the upper dental arch of the human mouth. As stated above, the end portions could have any number of fangs attached, thus creating any appearance desired.

In the preferred embodiment, the first fang 1 is attached to the first end portion 4 of the connecting member by means of the PVC injection molding process. The second fang 2 is, of course, attached in the same manner. Other attachment methods may be utilized if desired. For instance, the fangs may be press-fit onto the end portions, mechanical friction being the attachment mechanism. Also, glue may be used to secure the fangs to the end portions.

The first end portion 4 and the second end portion 5 are connected, in the preferred embodiment, by the intermediate portion 6. In the preferred embodiment, the intermediate portion 6 is loop-shaped. Other embodiments may require the intermediate portion 6 to be shaped differently. The intermediate portion 6 of the connecting member 3 resides underneath the tongue of the wearer when the disguise apparatus is inserted into the human mouth. The intermediate portion 6 can be seen in FIG. 2 contacting the floor of the human mouth. The intermediate portion 6 is loop-shaped so as to facilitate comfortable wear of the makeup apparatus for long, continuous periods of time. The intermediate portion 6 also serves as an attachment device for the first roller member 7 and the second roller member 8. The first roller member 7 and the second roller member 8 are attached to opposed end portions of the intermediate portion 6.

The connecting member 3, shown in FIG. 1, is made of a metallic wire. The metallic wire is employed in the preferred embodiment because it exhibits the properties of flexibility and elasticity necessary to insure comfortable insertion and wear in the human mouth. However, the connecting member 3 could be made of other materials such as plastic.

The first roller member 7 and the second roller member 8 reside between the upper and lower molar teeth as shown in FIG. 3. The roller members' location can also be seen in FIG. 2. Although both FIG. 2 and FIG. 3 show the roller members residing in the vicinity of the molar teeth, that is not an absolute requirement. For instance, depending on mouth size and stage of development, the roller members may be located further back or forward in the human mouth.

The roller members are made of injection-molded polyvinylchloride (PVC). PVC has been found ideal for protracted, comfortable use within the human mouth. The roller members could, however, be constructed of other material(s) which are suitable for use in the mouth. One such material would be rubber. Also, a combination of materials may be used as roller members, such as rubber and PVC.

The first roller member 7 and the second roller member 8 are very important in the instant invention in that they provide the force necessary to actuate the first fang 1 and the second fang 2, thus giving the disguise apparatus' wearer a vampire-like appearance. The propelling force could also be described as a mechanical "moment" or "torque". The propelling force occurs when the wearer bites down on the first roller member 7 and the second roller member 8 simultaneously as shown in FIG. 3, and then moves his lower dental arch (and jaw) with respect to his upper dental arch. The biting action and the relative movement of the lower dental arch are, in combination, responsible for the propelling force. It is important to note that FIG. 3 shows only the biting action with respect to the roller member 7. However, the principle is identical with respect to the roller member 8. The biting action was not shown in the figures with respect to the roller member 8 so as to avoid duplicity.

The biting action and the relative lower dental arch (and jaw) movement, as stated above, create the propelling force or moment. The propelling force or moment, in turn, causes the first end portion 4, the second end portion 5 and the intermediate portion 6 of the connecting member 3 to move. Since the first fang 1 and the second fang 2 are connected to the first end portion 4 and the second end portion 5 respectively, the fangs will also move.

FIG. 4 shows the first fang 1 and the second fang 2 in the retracted position. FIG. 4 also shows the first end portion 4 and the second end portion 5, with respective fangs attached thereto. FIG. 4 shows the position of the fangs before the biting action and relative movement of the lower dental arch takes place.

FIG. 5 shows the first fang 1 and the second fang 2 in the extended position, thus giving the wearer a vampire-like appearance. FIG. 5 shows use of the disguise apparatus subsequent to the biting action and relative movement of the lower dental arch.

FIG. 4 illustrates use of the disguise apparatus in the retracted position. While in the retracted position, the disguise apparatus is comfortable and can be worn for long periods of time. Because the disguise apparatus does not, in any fashion, restrict the passage of air or fluids through the mouth, use at parties or other social functions is comfortable and enjoyable.

It is important to note that the disguise apparatus may be operated in several modes different from the preferred embodiment. For instance, the wearer may actuate the fangs by pushing or pulling the intermediate portion 6 of the connecting member 3 with his tongue. This mode of operation is effective, but is not as efficient and comfortable as the preferred embodiment described hereinabove. In this mode of operation the roller members serve more as pivots than they do as torque-transmitting members.

The disguise apparatus could also be used in at least one other mode, that being upside down. When used in the upside-down mode, the apparatus is propelled in the same fashion as it was in the preferred embodiment. The apparatus is placed in the mouth upside down and then the same biting and relative movement of the lower dental arch is employed, only, in this mode of operation, the fangs are extending upwards rather than downwards.

The vast majority of the specification has been directed toward the preferred embodiment, but it is necessary to be cognizant of other possible constructions. Those constructions may entail the modification of the connecting member 3 such that: the intermediate portion 6 is formed differently or eliminated; and, or, the first end portion 4 and the second end portion 5 join or nearly join. Still other constructions may employ any number of teeth as discussed hereinabove.

Alternate constructions could be actuated in the same fashion as the preferred embodiment or, they could be actuated in any of the other methods described hereinabove.

Although the preferred embodiment of this invention has been described with specificity, it is understood that the present disclosure of the preferred embodiment is by way of example only and that numerous changes may be made to its construction and arrangement without deviating from the spirit and scope of the invention as hereinafter claimed.

What is claimed is:

1. A disguise apparatus simulating extendable human fangs comprising a first fang and a second fang, a connecting member, said connecting member having a first end portion, a second and portion and an intermediate portion, a first roller member and a second roller member, said first fang attached to said first end portion of said connecting member, said second fang attached to said second end portion of said connecting member, said first roller member and said second roller member attached to opposed ends of said intermediate portion of said connecting member, said first and second roller members being adapted to be engaged by the teeth of user to effect movement of said fangs.

2. An apparatus as claimed in claim 1 wherein said connecting member is comprised of a metallic wire.

3. An apparatus as claimed in claim 1 wherein said first end portion and said second end portion of said connecting member are adapted to reside primarily around the upper dental arch of the human mouth, and said intermediate portion of said connecting member is adapted to reside primarily below the tongue of the human mouth.

4. An apparatus as claimed in claim 2 wherein said first end portion and said second end portion of said connecting member are adapted to reside primarily around the upper dental arch of the human mouth, and said intermediate portion of said connecting member is adapted to reside primarily below the tongue of the human mouth.

5. A disguise apparatus simulating extendable human fangs comprising a first fang and a second fang, a connecting member, said connecting member having a first end portion, a second end portion and an intermediate portion, said first fang connected to said first end portion of said connecting member, said second fang connected to said second end portion of said connecting member, said first end portion and said second end portion of said connecting member being generally formed in the shape of the upper dental arch of the human mouth, a first roller member and a second roller member, said first and second roller members being attached to opposed end portions of said intermediate portion and adapted to reside primarily between the molar teeth of the upper and lower dental arches of the human mouth.

6. An apparatus as claimed in claim 5 wherein said intermediate portion of said connecting member is adapted to primarily reside underneath the human tongue.

7. A disguise apparatus simulating extendable human fangs comprising a first fang and a second fang, a connecting member, said connecting member having a first end portion, a second end portion, and an intermediate portion, a first pivot member and a second pivot member, said first fang attached to said first end portion of said connecting member, said second fang attached to said second end portion of said connecting member, said first pivot member and said second pivot member attached to said intermediate portion of said connecting member, said first end portion of said connecting member and said second end portion of said connecting member are adapted to reside primarily along the upper dental arch of the human mouth, said intermediate portion of said connecting member is adapted to reside primarily below the human tongue, said first and second pivot members being adapted to be engaged by the teeth of a user to effect movement of said fangs.

8. An apparatus as claimed in claim 7 wherein said connecting member is comprised of a metallic wire.

9. A disguise apparatus simulating extendable human fangs comprising a first fang and a second fang, a connecting member, said connecting member having a first portion, a second portion and a third portion, a first pivot member and a second pivot member, said first fang being attached to a first end of said first portion of said connecting member, said second fang being attached to a first end of said second portion of said connecting member, said first pivot member and said second pivot member being attached respectively to a second end of said first and second portions of said connecting member, said third portion of said connecting member connecting said first and second portions, said first and second pivot members being adapted to be engaged by the teeth of a user to effect movement of said fangs.

* * * * *